US011536115B2

(12) United States Patent
Zhu

(10) Patent No.: US 11,536,115 B2
(45) Date of Patent: Dec. 27, 2022

(54) FLOW CONTROL NOZZLE AND SYSTEM

(71) Applicant: RGL Reservoir Management Inc., Calgary (CA)

(72) Inventor: Da Zhu, Calgary (CA)

(73) Assignee: Variperm Energy Services Inc., Calgary (CA)

( * ) Notice: Subject to any disclaimer, the term of this patent is extended or adjusted under 35 U.S.C. 154(b) by 0 days.

(21) Appl. No.: 17/258,689

(22) PCT Filed: Jul. 8, 2019

(86) PCT No.: PCT/CA2019/050942
§ 371 (c)(1),
(2) Date: Jan. 7, 2021

(87) PCT Pub. No.: WO2020/010449
PCT Pub. Date: Jan. 16, 2020

(65) Prior Publication Data

US 2021/0254435 A1 Aug. 19, 2021

Related U.S. Application Data

(60) Provisional application No. 62/695,625, filed on Jul. 9, 2018, provisional application No. 62/694,977, filed on Jul. 7, 2018.

(51) Int. Cl.

| | |
|---|---|
| ***E21B 41/00*** | (2006.01) |
| ***E21B 43/12*** | (2006.01) |
| ***F15D 1/02*** | (2006.01) |

(52) U.S. Cl.
CPC ..... *E21B 41/0078* (2013.01); *E21B 43/12* (2013.01); *F15D 1/025* (2013.01)

(58) Field of Classification Search
CPC ..... E21B 41/0078; E21B 43/24; E21B 43/20; E21B 43/12; E21B 43/08; E21B 43/29;
(Continued)

(56) References Cited

U.S. PATENT DOCUMENTS

| | | | |
|---|---|---|---|
| 4,648,455 | A | 3/1987 | Luke |
| 5,092,159 | A | 3/1992 | Chien |

(Continued)

FOREIGN PATENT DOCUMENTS

| | | | |
|---|---|---|---|
| CA | 2622939 | A1 | 10/2008 |
| CA | 2679148 | A1 | 3/2010 |

(Continued)

OTHER PUBLICATIONS

U.S. Appl. No. 17/054,120, Nozzle for Steam Injection, filed Dec. 2, 2020.

(Continued)

*Primary Examiner* — Yong-Suk (Philip) Ro
(74) *Attorney, Agent, or Firm* — Michael A. Bondi; Moss & Barnett

(57) ABSTRACT

A flow control system includes a nozzle for controlling the flow of fluids into production tubing from a hydrocarbon containing reservoir. The nozzle comprises a passage extending between an inlet and an outlet, wherein the passage comprises converging and diverging sections separated by a corner. The nozzle serves to effectively choke the flow of steam and thereby allows preferential production of hydrocarbons.

34 Claims, 14 Drawing Sheets

(58) Field of Classification Search
CPC . E21B 43/14; E21B 7/18; E21B 10/60; F15D 1/025
See application file for complete search history.

(56) References Cited

U.S. PATENT DOCUMENTS

| | | | | |
|---|---|---|---|---|
| 5,141,055 | A | 8/1992 | Chien | |
| 6,524,368 | B2 * | 2/2003 | Betting | B04C 3/00 96/389 |
| 6,708,763 | B2 | 3/2004 | Howard | |
| 7,419,002 | B2 | 9/2008 | Dybevik | |
| 7,537,056 | B2 | 5/2009 | MacDougall | |
| 8,474,535 | B2 | 7/2013 | Richards | |
| 8,496,059 | B2 | 7/2013 | Schultz | |
| 8,689,883 | B2 | 4/2014 | Kim | |
| 9,027,642 | B2 | 5/2015 | Sladic | |
| 9,249,649 | B2 | 2/2016 | Fripp | |
| 9,518,455 | B2 | 12/2016 | Franklin | |
| 9,631,461 | B2 | 4/2017 | Lopez | |
| 9,638,000 | B2 | 5/2017 | Dyck | |
| 2002/0162589 | A1 | 11/2002 | Lorch | |
| 2006/0048942 | A1 | 3/2006 | Moen | |
| 2006/0118296 | A1 | 6/2006 | Dybevik | |
| 2008/0041588 | A1 | 2/2008 | Richards | |
| 2008/0283238 | A1 | 11/2008 | Richards | |
| 2011/0198097 | A1 | 8/2011 | Moen | |
| 2012/0006563 | A1 | 1/2012 | Patel | |
| 2014/0319970 | A1 | 10/2014 | Sherrit | |
| 2015/0292300 | A1 | 10/2015 | Franklin | |
| 2016/0010425 | A1 | 1/2016 | Dyck | |
| 2016/0160616 | A1 | 6/2016 | Moen | |
| 2017/0044868 | A1 | 2/2017 | Van Petegem | |
| 2017/0058655 | A1 | 2/2017 | Lastiwka | |
| 2018/0030812 | A1 | 2/2018 | Ning | |
| 2018/0045027 | A1 | 2/2018 | Haley | |

FOREIGN PATENT DOCUMENTS

| | | | |
|---|---|---|---|
| CA | 2862161 | A1 | 5/2013 |
| CA | 2862111 | A1 | 8/2013 |
| CA | 2871354 | A1 | 6/2015 |
| CA | 2934369 | A1 | 6/2015 |
| CA | 2887860 | A1 | 1/2017 |
| CA | 2959880 | A1 | 9/2017 |
| CA | 2917392 | A1 | 1/2018 |
| CN | 101455923 | | 6/2009 |
| CN | 107989584 | | 5/2018 |
| WO | 2019090425 | A1 | 5/2019 |
| WO | 2020/069614 | A1 | 4/2020 |

OTHER PUBLICATIONS

U.S. Appl. No. 17/264,215, Nozzle and Steam Injection and Steam Choking, filed Jan. 28, 2021.
Non-Final Office Action received for U.S. Appl. No. 17/264,215 dated Jun. 4, 2021, 9 pgs.
International Search Report and Written Opinion received for Serial No. PCT/CA2019/050942 dated Sep. 17, 2019, 8 pgs.
International Search Report and Written Opinion received for PCT serial No. PCT/CA2019/050636 dated Jul. 17, 2019.
International Search Report and Written Opinion received for PCT serial No. PCT/CA2019/051407 dated Dec. 12, 2019.

* cited by examiner

Section B-B

Section A-A

FLOW CONTROL NOZZLE AND SYSTEM

CROSS REFERENCE TO RELATED APPLICATIONS

This application claims priority to PCT Application No. PCT/CA2019/050942, filed Jul. 8, 2019; U.S. Application No. 62/694,977, filed Jul. 7, 2018; and U.S. Application No. 62/695,625, filed Jul. 9, 2018. The contents of these prior applications are incorporated herein by reference in their entirety.

FIELD OF THE DESCRIPTION

The present description relates to flow control devices used for controlling flow of fluids into a tubular member. In a particular example, the described flow control devices control, or choke, the flow of steam from subterranean formations into production tubing.

BACKGROUND

Subterranean hydrocarbon reservoirs are generally accessed by one or more wells that are drilled into the reservoir to access the hydrocarbon materials. Such materials are then brought to the surface through production tubing.

The wellbores drilled into the reservoirs may be vertical or horizontal or at any angle there-between. In some cases, the desired hydrocarbons comprise a highly viscous material, such as heavy oil, bitumen and the like. In such cases, it is known to employ steam, gas or other fluids, typically of a lower density to assist in the production of the desired hydrocarbon materials. These agents are typically injected into one or more sections of the reservoir to stimulate the flow of hydrocarbons into production tubing provided in the wellbore. Steam Assisted Gravity Drainage, "SAGD", is one example of a process where steam is used to stimulate the flow of highly viscous hydrocarbon materials (such as heavy oil, bitumen etc. contained in oil sands). In a SAGD operation, one or more well pairs, where each pair typically comprises two vertically separated horizontal wells, are drilled into a reservoir. Each of the well pairs typically comprises a steam injection well and a production well, with the steam injection well being positioned generally vertically above the production well. In operation, steam is injected into the injection well to heat and reduce the viscosity of the hydrocarbon materials in its vicinity, in particular viscous, heavy oil material. After steam treatment, the hydrocarbon material, now mobilized, drains into the lower production well owing to the effect of gravity, and is subsequently brought to the surface through the production tubing.

Cyclic Steam Stimulation, "CSS", is another hydrocarbon production method where steam is used to enhance the mobility of viscous hydrocarbon materials. The first stage of a CSS process involves the injection of steam into a hydrocarbon-containing formation through one or more wells for a period of time. The steam is injected through tubing that is provided in the wells. In a second stage, steam injection is ceased, and the well is left in such a state for another period of time that is sufficient to allow the heat from the injected steam to be absorbed into the reservoir. This stage is referred to as "shut in" or "soaking") during which the viscosity of the hydrocarbon material is reduced. Finally, in a third stage, the hydrocarbons, now mobilized, are produced, often through the same wells that were used for steam injection. The CSS process may be repeated as needed.

The tubing referred to above typically comprises a number of coaxial pipe segments, or tubulars, that are connected together. Various tools are often provided along the length of the tubing and coaxially connected to adjacent tubulars. The tubing, for either steam injection or hydrocarbon production, generally includes a number of apertures, or ports, along its length, particularly in the regions where the tubing is provided in hydrocarbon-bearing regions of the formation. The ports provide a means for injection of steam, and/or other viscosity reducing agents from the surface into the reservoir, and/or for the inflow of hydrocarbon materials from the reservoir into the tubing and ultimately to the surface. The segments of tubing having ports are also often provided with one or more filtering devices, such as sand screens and the like, which serve to prevent or mitigate against sand and other solid debris in the well from entering the tubing.

As known in the art, particularly when steam is used to stimulate production of heavy hydrocarbon materials, the steam preferential enters the production tubing over the desired hydrocarbon materials. This generally occurs in view of the fact that steam has a lower density than the hydrocarbon material and is therefore more mobile or flowable. This problem is faced, for example, in SAGD operations where the steam from the injection well travels or permeates through the hydrocarbon formation and is preferentially produced in the production well.

To address the above-noted problem, steps are often taken to limit, or "throttle" or "choke", the flow of steam into production tubing, and thereby increase the production rate of hydrocarbon materials. To this end, various nozzles and other devices have been proposed that are designed to limit the flow of steam into production tubing. In some cases, a device such as a flow restrictor or similar nozzle is provided on a "base pipe" of the tubing to impede the inflow of steam. Examples of such flow control devices are described in: U.S. Pat. Nos. 9,638,000; 7,419,002; 8,496,059; and US 2017/0058655. Another apparatus for steam choking is described in the present applicant's co-pending PCT application, WO 2019/090425, the entire contents of which are incorporated herein by reference.

There exists a need for an improved flow control means to control or limit the introduction of steam into production tubing.

SUMMARY OF THE DESCRIPTION

In one aspect, there is provided a nozzle for controlling flow into a pipe, the pipe having at least one port along its length, the nozzle being adapted to be located on the exterior of the pipe, adjacent one of the at least one port, and wherein the nozzle chokes the flow of steam while preferentially allowing the flow of hydrocarbons and hydrocarbon-containing liquids.

In one aspect, there is provided a system for controlling flow of fluids from a hydrocarbon-containing subterranean reservoir into production tubing, the system comprising:

- a pipe segment adapted to form a section of the production tubing, the pipe segment having a first end and a second end and at least one port extending through the wall thereof for conducting reservoir fluids into the pipe segment;
- at least one nozzle provided on the pipe segment, the nozzle having an inlet for receiving reservoir fluids, an outlet arranged in fluid communication with the at least one port, and a fluid conveying passage, extending between the inlet and the outlet, for channeling reservoir fluids in a first direction from the inlet to the outlet;

the fluid conveying passage having:

a first converging region, proximal to the inlet, the first converging region having a reducing cross-sectional area in the first direction;

a diverging region, proximal to the outlet, the diverging region having a first end having a first diameter and a second end positioned at the outlet and having a second diameter, wherein the first diameter is smaller than the second diameter and wherein the diverging region has an increasing cross-sectional area over at least a portion thereof in the first direction; and, a corner defining the first end of the diverging region.

In another aspect, there is provided a nozzle for controlling flow of fluids from a subterranean reservoir into a port provided on a pipe, the nozzle being adapted to be located on the exterior of the pipe adjacent the port, the nozzle having an inlet for receiving reservoir fluids, an outlet arranged in fluid communication with the port, and a fluid conveying passage, extending between the inlet and the outlet, for channeling reservoir fluids in a first direction from the inlet to the outlet;

the fluid conveying passage having:

a first converging region, proximal to the inlet, the first converging region having a reducing cross-sectional area in the first direction;

a diverging region, proximal to the outlet, the diverging region having a first end having a first diameter and a second end positioned at the outlet and having a second diameter, wherein the first diameter is smaller than the second diameter and wherein the diverging region has an increasing cross-sectional area over at least a portion thereof in the first direction; and, a corner defining the first end of the diverging region.

BRIEF DESCRIPTION OF THE FIGURES

The features of certain embodiments will become more apparent in the following detailed description in which reference is made to the appended figures wherein.

DETAILED DESCRIPTION

Figure 1:
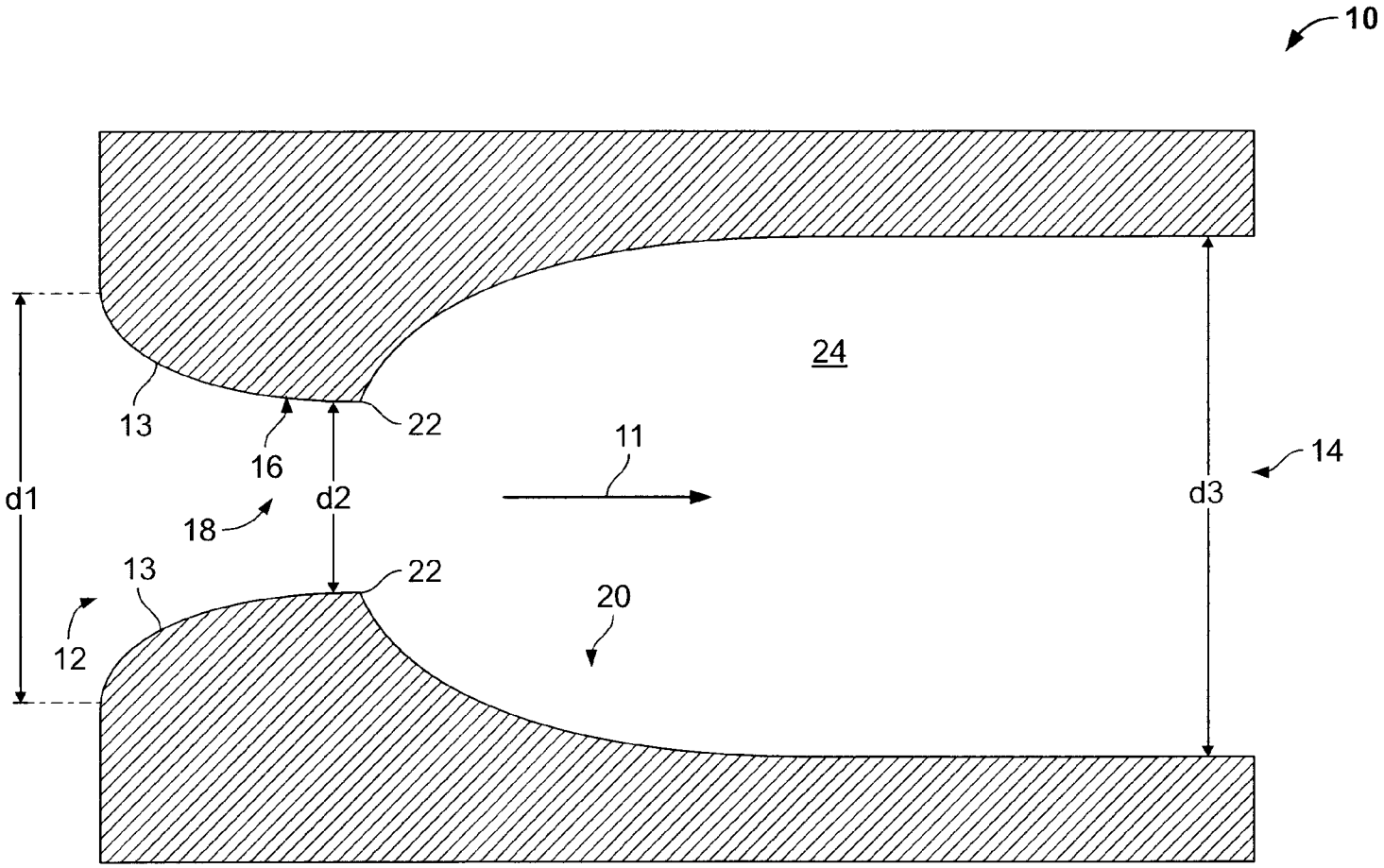
FIG. 1 is a side cross-sectional view of an inflow control nozzle according to an aspect of the present description.

As used herein, the terms "nozzle" or "flow control device", as used herein, will be understood to mean a device that controls the flow of a fluid flowing there-through. In one example, the nozzle described herein is an "inflow control device" or "inflow control nozzle" that serves to control the flow of fluids through a port from a subterranean formation into a pipe for production operations. It will be understood, that such nozzles may also allow for flow of fluids in an opposite direction, such as for injection operations.

The terms "regulate", "limit", "throttle", and "choke" may be used herein. It will be understood that these terms are intended to describe an adjustment of the flow rate of a fluid passing through the nozzles described herein. As discussed herein, the present nozzles are specifically designed to choke the flow of a low viscosity fluid, in particular steam. For the purposes of the present description, the flow of a fluid is considered to be "choked" if a further decrease in downstream pressure does not result in an increase in the velocity of the fluid flowing through the restriction. That is, the fluid velocity is limited and as a result, and assuming that all other variables remain unchanged, the mass flow rate of the fluid is also limited.

The term "hydrocarbons" refers to hydrocarbon compounds that are found in subterranean reservoirs. Examples of hydrocarbons include oil and gas. As will be apparent from the present description, the nozzles described herein are particularly suited for reservoirs containing heavy oils or similar high viscosity hydrocarbon materials.

The term "wellbore" refers to a well or bore drilled into a subterranean formation, in particular a formation containing hydrocarbons.

The term "wellbore fluids" refers to hydrocarbons and other materials contained in a reservoir that enter a wellbore. The present description is not limited to any particular wellbore fluid(s).

The terms "pipe" or "base pipe" refer to a section of pipe, or other such tubular member. The base pipe may be provided with one or more openings or slots, collectively referred to herein as ports, at various positions along its length to allow flow of fluids there-through.

The terms "production" or "producing" refers to the process of bringing wellbore fluids, in particular the desired hydrocarbon materials, from a reservoir to the surface.

The term "production tubing" refers to a series of pipes, or tubulars, connected together and extending through a wellbore from the surface into the reservoir. Production tubing may be used for producing wellbore fluids.

The terms "screen", "sand screen", "wire screen", or "wire-wrap screen", as used herein, refer to known filtering or screening devices that are used to inhibit or prevent sand or other solid material from the reservoir from flowing into production tubing. Such screens may include wire wrap screens, precision punched screens, premium screens or any other screen that is provided on a base pipe to filter fluids and create an annular flow channel. The present description is not limited to any particular screen or screen device.

The terms "comprise", "comprises", "comprised" or "comprising" may be used in the present description. As used herein (including the specification and/or the claims), these terms are to be interpreted as specifying the presence of the stated features, integers, steps or components, but not as precluding the presence of one or more other feature, integer, step, component or a group thereof as would be apparent to persons having ordinary skill in the relevant art.

In the present description, the terms "top", "bottom", "front" and "rear" may be used. It will be understood that the use of such terms is purely for the purpose of facilitating the present description and are not intended to be limiting in any way unless indicated otherwise. For example, unless indicated otherwise, these terms are not intended to limit the orientation or placement of the described elements or structures.

The present description relates to a flow control device or nozzle, in particular an inflow control device, for controlling or regulating the flow of fluids from a reservoir into production tubing. As discussed above, such regulation is often required in order to preferentially produce desired hydrocarbon materials instead of undesired fluids, such as steam. As also discussed above, the production of steam, such as in a SAGD operation, commonly occurs as steam has a much lower density than many hydrocarbon materials, such as heavy oil and the like. The steam, being much more mobile than the heavy oil, also preferentially travels towards and into the production tubing. The nozzles described herein serve, in one aspect, to throttle or regulate the inflow of steam into production tubing.

Figure 3:
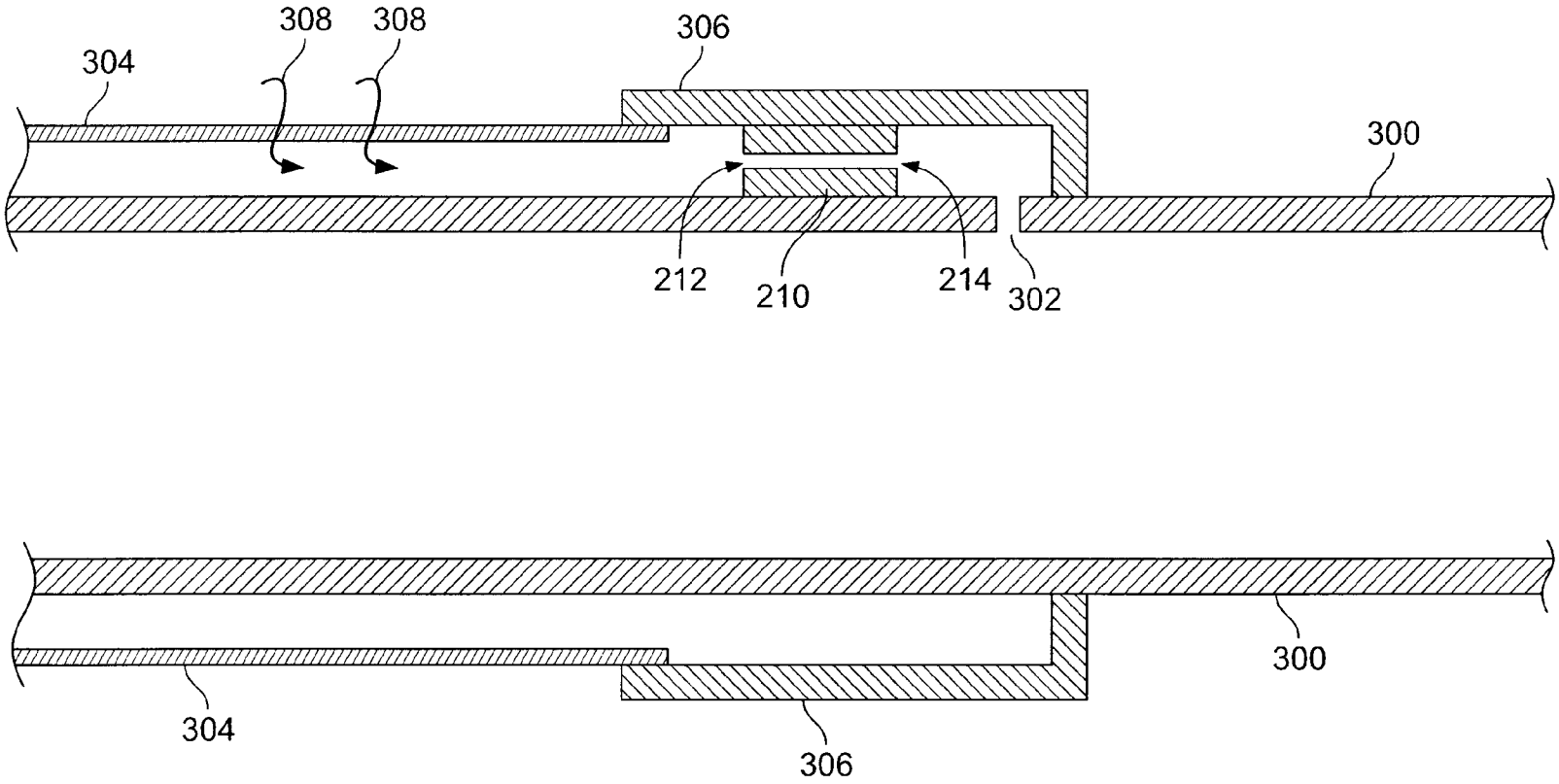
FIG. 3 is a side cross-sectional view of an inflow nozzle according to an aspect of the present description, in combination with a pipe.

As would be understood by persons skilled in the art, the nozzles described herein are preferably designed to be included as part of an apparatus associated with tubing, an example of which is illustrated in FIG. 3 (discussed further below). That is, the nozzles are adapted to be secured to tubing, at the vicinity of one or more ports provided on the tubing and serve to control the flow of fluids into the tubing after having been filtered to remove solid materials. The nozzles may be retained in the required position by any means, such as by collars or the like commonly associated with sand control devices, such as wire wrap screens etc. In one aspect, the present nozzles may be located or positioned within slots or openings cut into the wall of the pipe or tubing. It will be understood that the means and method of securing the nozzle to the pipe is not limited to the specific descriptions provided herein and that any other means or method may be used, while still retaining the functionality described herein.

Figure 1A:
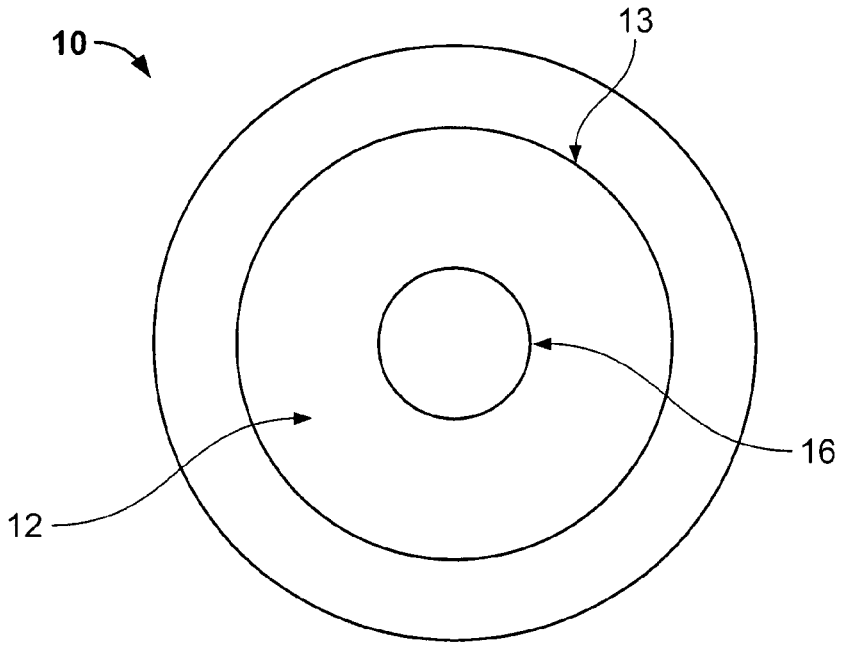
FIG. 1*a* is an end view of the inlet of the nozzle of FIG. 1.

FIGS. 1 and 1*a* illustrate one aspect of a nozzle according to the present description. As shown, the nozzle 10 comprises a generally cylindrical body (as shown by way of example in FIGS. 8*c* and 9*c*) having an inlet 12 and an outlet 14 and a passage extending there-through. Fluid flows through the nozzle 10 in the direction shown by arrow 11. The inlet 12 receives fluid from a reservoir (not shown). After passing through the nozzle 10, the fluid exits through the outlet 14. The passage extending between the inlet 12 and outlet 14 comprises a convergent-divergent region define by a throat 16. More particularly, as shown in FIG. 1, the inlet 12 is provided with an inlet diameter d1, whereas the throat 16, located downstream of the inlet, is provided with throat diameter d2, that is smaller than d1. The outlet 14 is provided with an outlet diameter d3 that is larger than d2 and, in one aspect, larger than d1. In other aspects, the outlet diameter d3 may be the same or smaller in dimension than d1. However, d3 is preferably larger than d1 as would be understood in view of the present description.

The inlet 12 is formed with a gradually narrowing opening 13, that forms a region of reducing cross-sectional area. The opening 13 preferably has a smooth wall according to one aspect. Thus, the opening 13 has a generally funnel-like shape.

The inlet 12 extends to the throat 16, where the diameter of the opening is reduced to d2. The throat 16 may be of any length having a constant diameter, or cross-sectional area.

Figure 4:
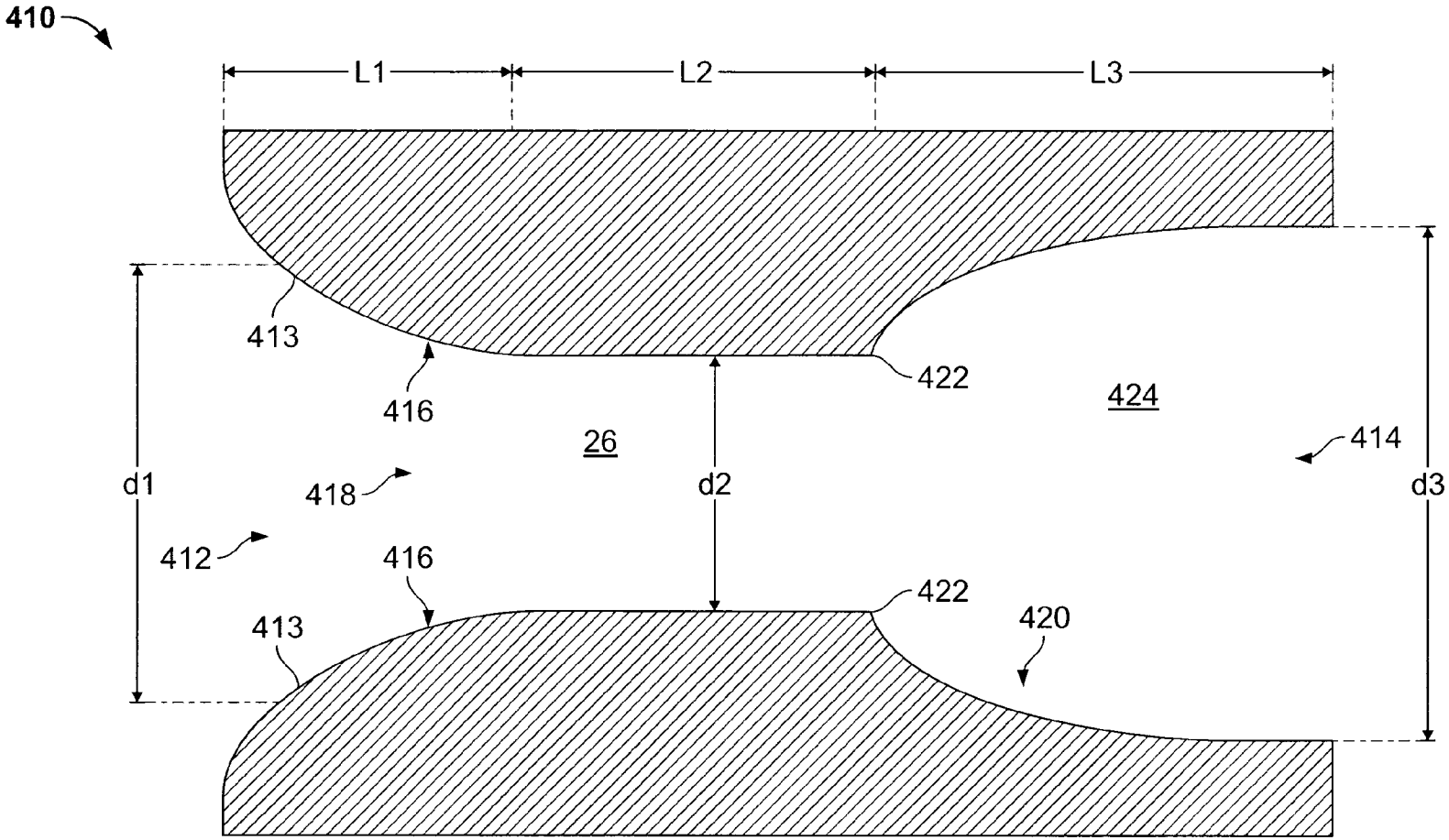
FIG. 4 is a side cross-sectional view of an inflow control nozzle according to another aspect of the present description.

As would be understood from the present description, the length of the opening 13, extending from the inlet 12 to the throat 16, and the length of the throat 16 may be of any size and may vary depending on the characteristics of the fluids being produced. In particular, as discussed below, the purpose of the narrowing opening 13 and throat 16 is to increase the velocity and reduce the pressure of the fluid flowing there-through. Persons skilled in the art would therefore appreciate the length of the opening required to achieve this result based upon the nature of the fluids in the reservoir in question. An example of a nozzle according to the present description and having an elongated throat section is shown in FIG. 4 and described further below.

The portion of the passage extending from the throat 16 and in the direction 11 is provided with an increasing diameter, up to at least the diameter d3 of the outlet 14. In this way, the portion of the nozzle passage extending from the inlet 12 to the throat 16 comprises a converging section 18 and the portion of the passage downstream from the throat 16 and towards the outlet 14 (that is, in the direction 11) comprises a diverging section 20, which opens into an expansion, or pressure recovery region 24. As will be understood, in region 20, the velocity of the flowing fluids is decreased resulting in an increase in pressure. In FIG. 1, the nozzle passage is shown as reaching the diameter d3 upstream of the outlet 14. It will be understood that in other aspects, the passage downstream of the throat 16 may have a continuously increasing diameter, with the cross-sectional area thereof increasing up to the outlet 14.

As shown in FIG. 1, the passage of nozzle 10, consisting of the converging section 18 and a diverging section 20, may appear generally similar in structure to a Venturi nozzle (such as that taught in U.S. Pat. No. 9,638,000). As known in the art, a Venturi nozzle comprises a throat resulting in a converging section and a diverging section for fluid flow. The converging and diverging sections as well as the throat of a Venturi nozzle comprise smoothly curved surfaces, whereby the converging and diverging sections comprise smooth conical surfaces. Such Venturi nozzles, which specifically have no surface defects, are used to generate desired flow characteristics by employing the Venturi effect, namely a gradual increase in velocity, and concomitant pressure reduction, of the fluid flowing through the throat followed by a gradual decrease in velocity and pressure increase, i.e. pressure recovery, in the diverging section following the throat. Thus, with Venturi nozzles, the pressure recovery of the fluid, resulting from the expansion of the fluid, occurs over the entire diverging section.

In contrast to a Venturi nozzle, the nozzle 10 of FIG. 1 includes a sharp transition corner, cusp, or edge 22 (referred to herein as a "corner") defining a relatively rapid transition from the throat 16 to the diverging section 20. In one aspect, the corner 22 is defined by a surface that is mathematically not differentiable. With the nozzle 10, the expansion of the flowing fluid occurs rapidly at the specific location or point of the corner 22. Without being bound to any particular theory, it is believed that the flowing fluid undergoes a Prandtl-Meyer expansion at the corner 22, as opposed to the gradual expansion typically resulting within a Venturi nozzle. Such Prandtl-Meyer expansion, or the creation of a Prandtl-Meyer expansion "fan", particularly occurs when the fluid flowing through the throat 16 is at or about sonic velocities (i.e. a Mach number equal to or greater than 1).

Thus, with the structure of the subject nozzle 10, in particular with the presence of the corner 22, a hot fluid (such as steam or a hot gas) flowing through the passage of the nozzle 10 is subjected to a pressure drop in the throat 16 and is flashed (i.e. the pressure within the throat is reduced below the vapour pressure of the fluid). The flowing fluid is then subjected to mixing at the corner 22. In the absence of steam or where the concentration of steam is below a certain value, the vapour pressure of the fluid is below the pressure in the throat 16 and, therefore, the flow rate of the fluid is maintained. Therefore, the present nozzle 10 provides an improvement in steam choking as compared to known Venturi nozzles.

More specifically, and without being bound to any particular theory, fluid flowing from a reservoir into production tubing may comprise one or more of: a "cold fluid", comprising a single phase of steam/water and hydrocarbons; a "hot fluid", comprising more than one phase, in particular a steam phase and a liquid hydrocarbon phase; and, steam, in particular wet steam, which may also contain a hydrocarbon component but would still constitute a single phase. The nozzle described herein is primarily designed to convert a "hot fluid", or multiple phase fluid, into a single phase.

When wet steam or a hot fluid and steam mixture is flowed through the presently described nozzle, the converging section will cause acceleration of the fluid flow, that is, an increase in the fluid velocity. This increase in velocity is associated with a corresponding decrease in the pressure of the fluid. The generated pressure drop will generally result in the separation of steam from the fluid mixture, thereby resulting in a more discrete steam phase. Ideally, before the fluid reaches the corner 22, the steam will be completely separated and will reach a state of equilibrium with the water content of the flowing fluid. Once removed from the rest of the fluid, and into a separate phase, it will be understood that the steam would have an increased velocity as it travels through the nozzle. This increased velocity is believed to serve as a carrier for the liquid phase of the fluid. As will be understood, the increase in velocity that is achieved by the nozzle described herein serves to further increase the pressure drop of the fluid, wherein, according to Bernoulli's principle, such pressure drop is proportional to the square of the flow velocity. In other words, an increase in the fluid velocity results in an exponential increase in the pressure drop. Thus, in one aspect, the nozzle described herein achieves a greater pressure drop by increasing the fluid velocity in a unique manner.

The expansion region 24 of the nozzle, following after corner 22, functions as a pressure recovery chamber, where the total pressure of the flowing fluid is increased, or "recovered". In the expansion region 24, the steam/water (in equilibrium) and hydrocarbon phases of the fluid are combined into a single phase. Preferably, in the expansion region 24, the fluid pressure is increased to the prescribed outlet pressure so as to avoid the formation of shockwaves within the nozzle. Compared to the long gradual expansion section in a known Venturi nozzle, the sharp corner 22 of the presently described nozzle provides the immediate and initial expansion for the pressure recovery. Thus, by using a nozzle as described herein with the corner 22, a high-quality (i.e. hydrocarbon rich) flow can be maintained with a relatively shorter nozzle.

Figure 6B:
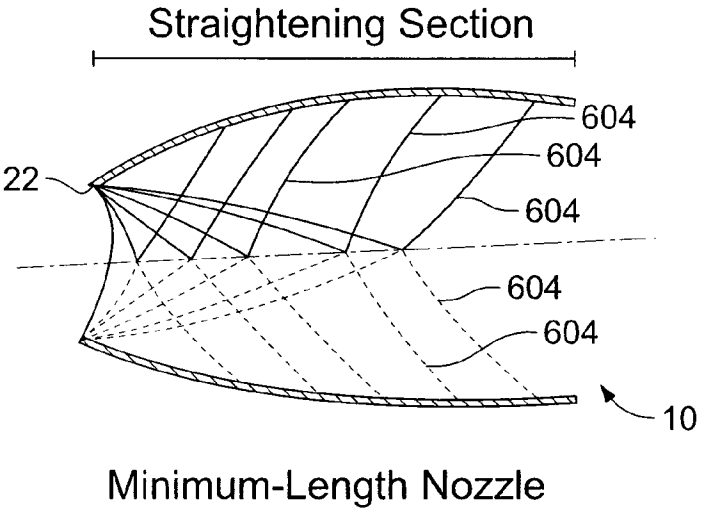
FIG. 6*b* is a schematic illustration of fluid flow characteristics through the nozzle of FIG. 1.
Figure 6A:
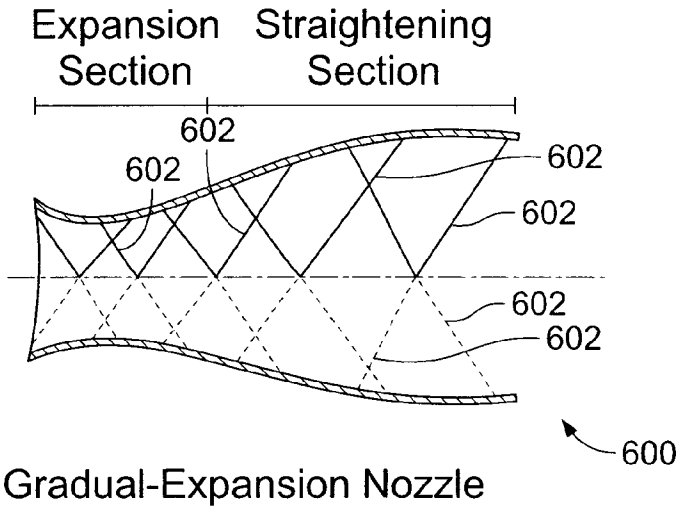
FIG. 6*a* is a schematic illustration of fluid flow characteristics through a Venturi nozzle.

FIGS. 6*a* and 6*b* illustrate the above-mentioned flow characteristics between a typical Venturi nozzle 600 and a nozzle 10 as shown in FIG. 1 having the corner 22. The flow characteristics are illustrated in FIGS. 6*a* and 6*b* by means of wave reflection contour lines 602 and 604, respectively.

Figure 2:
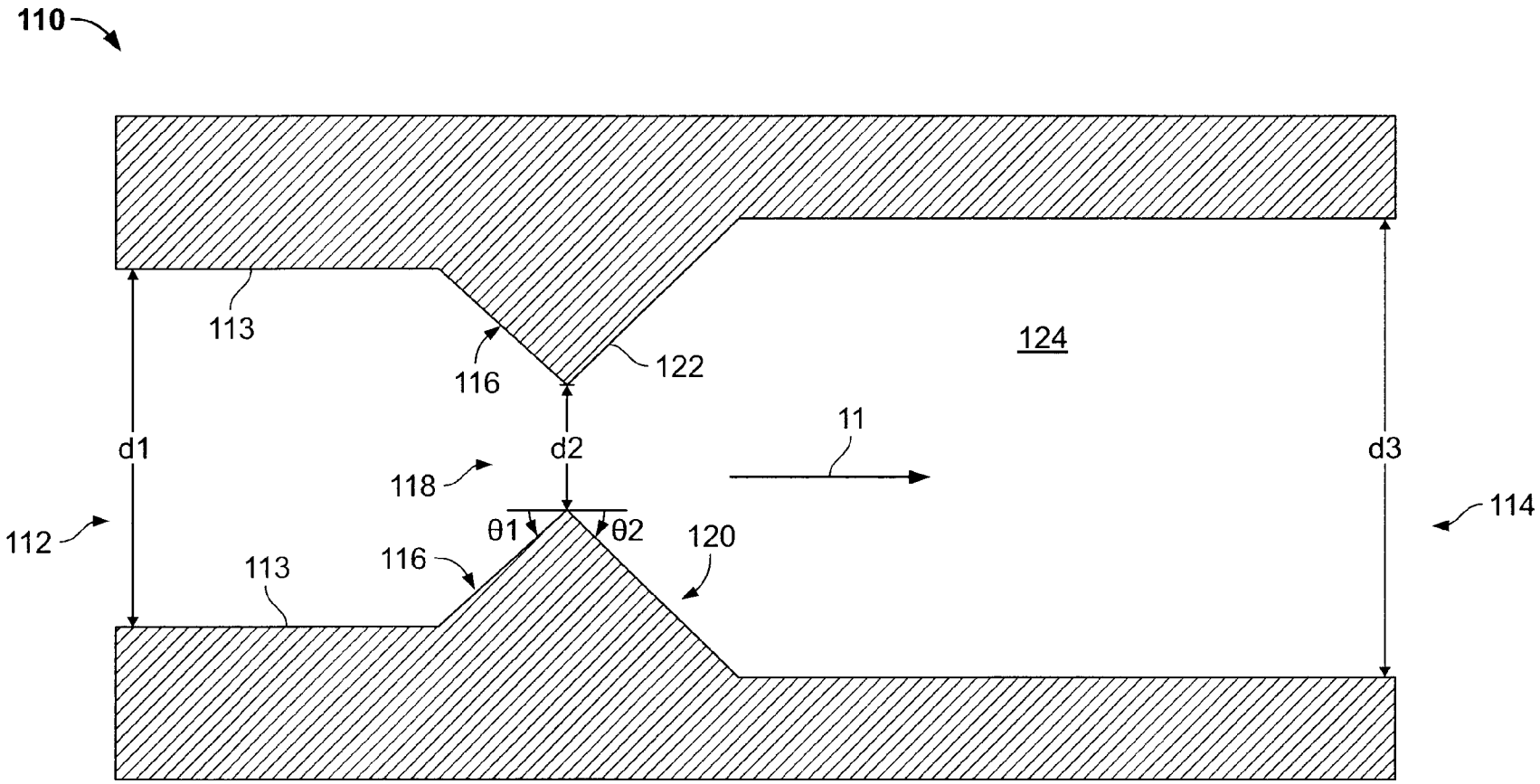
FIG. 2 is a side cross-sectional view of an inflow control nozzle according to another aspect of the present description.

FIG. 2 illustrates another aspect of the presently described nozzle, where like elements are identified with the same reference numeral as above, but with the prefix "1". As shown, the nozzle 110 comprises a body having an inlet 112, an outlet 114, and passageway provided there-between. The passageway includes a converging section 118 and a diverging section 120 separated by a throat 116. As with the previously described aspect of the nozzle, the nozzle 110 of FIG. 2 includes a throat 116 having a sharp corner 122. The respective diameters of the inlet 112, throat 116, and outlet 114 are shown as before by d1, d2, and d3. The nozzle 110 also includes a region, defined by wall 113, adjacent the inlet 112. The wall 113 may define a region of constant cross-sectional area or a region with a reducing diameter along the direction of flow 11.

As illustrated, the nozzle 110 of FIG. 2 includes a throat 116 defined by conical sections when viewed in cross-section. The wall defining the converging section 118 is provided at an angle θ1 while the wall defining the conical diverging section 120 is provided an angle θ2, where both θ1 and θ2 are measured with respect to the longitudinal axis of the nozzle 110 or, in other words, the direction of flow 11. As illustrated both θ1 and θ2 are acute angles, thereby resulting in the corner 122.

FIG. 3 schematically illustrates a fluid flow control system or apparatus comprising a pipe that is provided with at least one nozzle as described herein (both above and below). As shown, a pipe 300 comprises an elongate tubular body having a number of ports 302 along its length. The ports 302 allow fluid communication between the exterior of the pipe and its interior, or lumen. As is common, pipes used for production (i.e. production tubing) typically include a screen 304, such as a wire-wrap screen or the like, for screening fluids entering the pipe. The screen 304 serves to prevent sand or other particulate debris from the wellbore from entering the pipe. The screen 304 is provided over the surface of the pipe 300 and is retained in place by a collar 306 or any other such retaining device or mechanism.

It will be understood that the system of the present description does not necessarily require the presence of a screen, although such screens are commonly used. The present description is also not limited to any type of screen 304 or screen retaining device or mechanism 306.

The present description is also not limited to any number of ports 302. Furthermore, it will be appreciated that while the presence of a screen 304 is shown, the use of the presently described nozzle is not predicated upon the presence of such screen. Thus, the presently described nozzle may be used on a pipe 300 even in the absence of any screen 304. As would be understood, in cases where no screen is used, a retaining device, such as a clamp 306 or the like, may still be utilized to secure nozzle 210 to the pipe 300. Alternatively, the nozzle 210 may be secured to the pipe in any other manner as would be known to persons skilled in the art.

As shown in FIG. 3, a nozzle according to the present description is shown generally at 210. It will be understood that the illustration of nozzle 210 is schematic and is not intended to limit the structure of the nozzle to any particular shape or structure. Thus, the nozzle 210 of FIG. 3 may consist of one of the nozzles described above, as shown in FIGS. 1 and 2 or any other nozzle configuration in accordance with the present description.

As shown in FIG. 3, the nozzle 210 is positioned on the outer surface of the pipe 300 and located proximal to the port 302. In particular, the outlet 214 of the nozzle is positioned so that fluids exiting the nozzle 210 enter into the port 302. Further, by positioning the nozzle 210 downstream of the screen 304, the fluids are filtered of debris etc. prior to entering the nozzle 210. As shown schematically in FIG. 3, and as shown in other figures of the present application, the passage through the nozzle is generally aligned, and often parallel with, the longitudinal axis of the pipe 300. For this reason, it will be understood that some form of diversion means will be provided between the nozzle outlet 214 and the port 302 in order to diver the fluid from the outlet 214 into the port 302. An example of such diverter is provided in WO 2019/090425.

In use, the pipe 300 is provided with the nozzle 210 and, where needed, the screen 304. The pipe 300 is then inserted into a wellbore to begin the production procedure. During production, wellbore fluids, as shown at 308, pass through the screen 304 (if present) and are diverted to the nozzle 210. As discussed above, the nozzle 210 has a passageway with converging and diverging sections. Where the wellbore fluids primarily comprise desired hydrocarbons, such as oil and heavy oil etc., flow through the nozzle 210 is uninterrupted and such fluids enter into the port 302 and into the pipe, or production tubing 300. However, where the fluids 308 comprise steam (as would occur in steam breakthrough in a SAGD operation), the nozzle functions as described above and effectively chokes the flow of such low-density fluid. Other ports along the length of the pipe would continue to produce the desired hydrocarbons. In the result, over its length, the pipe, or production tubing, would preferentially produce hydrocarbons while choking the flow of steam at those regions where steam breakthrough has occurred.

As will be understood, although the present description is mainly directed to the choking of steam inflow, the presently described nozzles may also be used to choke the flow of other "undesired" fluids such as water and gas that are found in combination with desired hydrocarbons, or other low density fluids that are injected into the formation such as viscosity modifiers, solvents etc.

A further aspect of the present description is shown in FIG. 4, where elements that are similar to those of FIG. 1 are identified with the same reference numeral as above, but with the prefix "4" for convenience. In FIG. 4, the throat 416 is longer than the throat 16 shown in FIG. 1. Such an elongated throat forms a duct region 26, having a generally constant cross-sectional area that fluidly connects the converging section 418 and the diverging section 420. An edge 422 is also preferably provided at the transition point between the throat 416 and the expansion region 424, for the reasons noted above. As shown, and according to one aspect, the duct region 26 may have a constant diameter, corresponding to the diameter d2 as defined above. With the nozzle of FIG. 4, the converging section 418 has a smooth curved shape, as discussed above, and formed by opening 413, which helps the inflow of both single-phase liquid and the unwanted wet steam. As with the nozzle 10 of FIG. 1, the smooth walled converging section 418 of the nozzle 410 promotes the flow of the single-phase liquid there-through due to the higher viscosity of such fluid. The duct region 26 downstream of the converging section 418, having a constant cross-sectional area, functions to further encourage the steam component to separate from the fluid and reach an equilibrium state. Thus, the duct region 26 serves to further accelerate the fluid passing there-through and further augment the pressure drop mentioned above. In one aspect, the nozzle 410 having a duct region 26 would be preferred in situations where it is desired to generate higher pressure drops in the presence of wet steam/water flashing. Downstream of the duct region 26, flow velocity is proportional to the volumetric flow rate. Therefore, when steam is completely separated from the fluid, the volumetric flow rate will be increased, and the pressure drop (i.e. the pressure differential) will be increased accordingly.

In one example, the nozzle 410 illustrated in FIG. 4, as well as the nozzle 10 illustrated in FIG. 1, may have the following dimensions:

| | |
|---|---|
| d1 | 10 mm |
| d2 | 4 mm |
| d3 | 7 mm |
| L1 | 20 mm |
| L2 | 15 mm |
| L3 | 100 mm |

It will be understood that the dimensions of the nozzle described herein will vary based on the intended use. For example, the diameter of the throat d2 would generally be determined by the pressure of the reservoir and the desired production rate. Generally, the length of the nozzle would be fixed as it would be limited by the equipment being used for the production phase.

Figure 5:
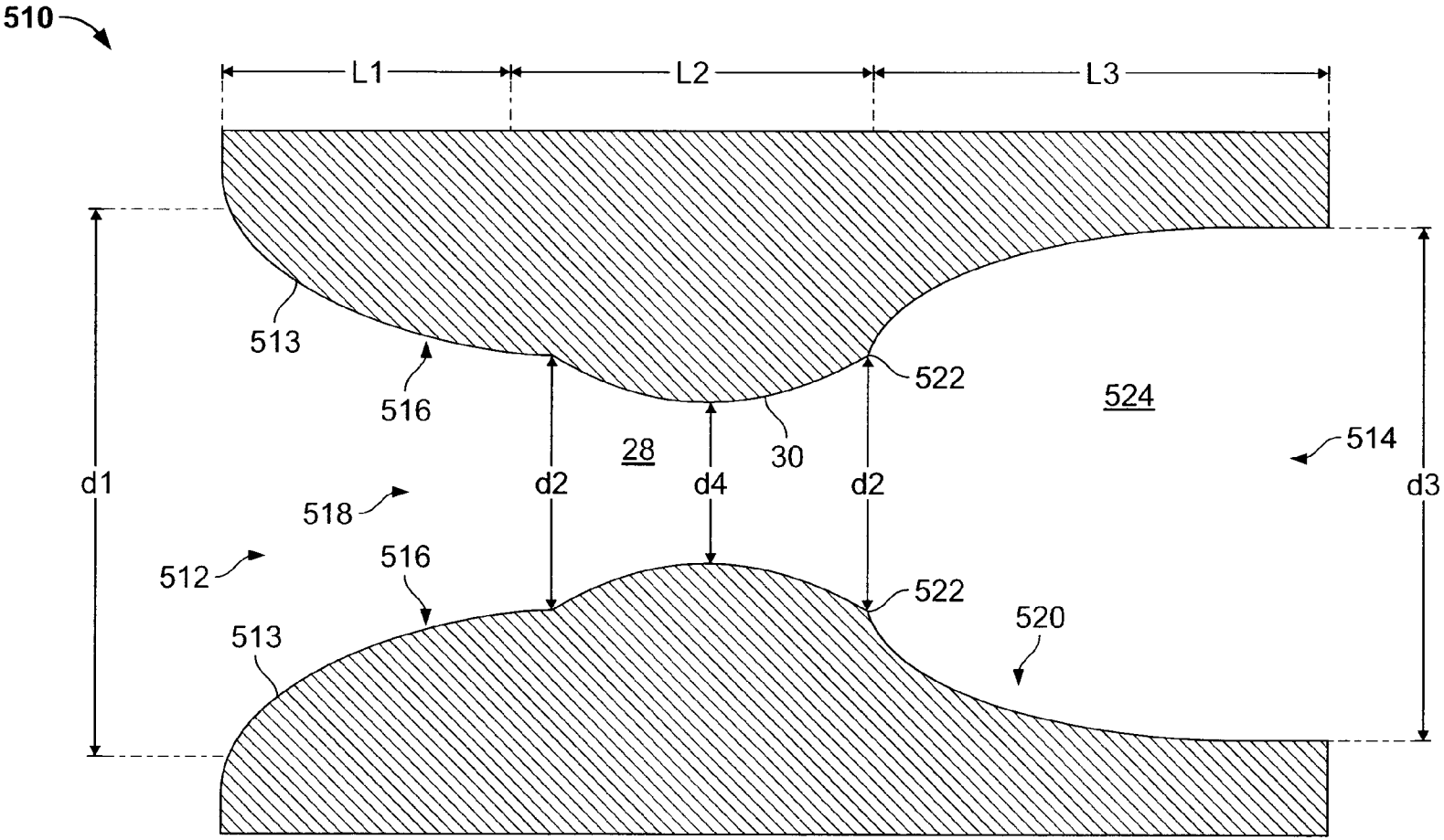
FIG. 5 is a side cross-sectional view of an inflow control nozzle according to another aspect of the present description.

A further aspect of the present description is shown in FIG. 5, where elements that are similar to those of FIG. 1 are identified with the same reference numeral as above, but with the prefix "5" for convenience. As shown, the nozzle 510 shown in FIG. 5 is similar in structure to the nozzle 410 of FIG. 4; however, the duct region of this nozzle, identified as 28, does not have a constant cross-sectional area. Instead, the duct region 28 of nozzle 510 includes a converging and diverging profile in cross section that is formed by a narrowed region 30 having a diameter d4 at the narrowest point. As shown, diameter d4 is less than diameter d2. Thus, the nozzle of FIG. 5 includes two constriction zones in series. This geometry of the duct region 28 would serve to further accelerate the fluid flowing therethrough and thereby enhance the effects discussed above. Although the opposite ends of the duct region 28 are shown to have the same diameter, d2, this is by way of example only and it will be understood that the opposite ends may also have different diameters. In either case, the diameter d4 would still be less than the diameters of the opposite ends.

In one example, the nozzle 510 illustrated in FIG. 5 may have the same dimensions as provided in the table above with respect to the nozzle of FIG. 4. Although not recited in the table, the diameter d4 of duct region 28 would be understood to have a smaller dimension than diameter d2.

Figure 7:
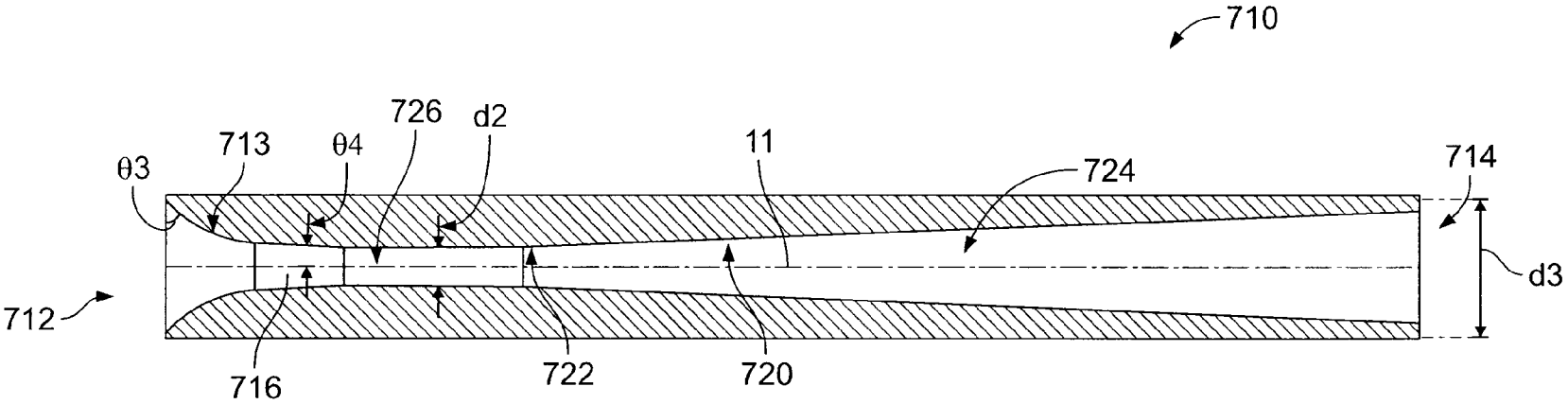
FIG. 7 is a side cross-sectional view of an inflow control nozzle according to another aspect of the present description.
Figure 7A:
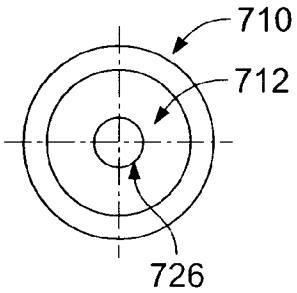
FIG. 7*a* is an end view of the inlet of the nozzle of FIG. 1.

FIG. 7, as well as associated FIG. 7*a*, illustrates a further aspect of the description, wherein elements similar to those already introduced are identified with the prefix "7". The nozzle 710 illustrated in FIG. 7 is similar to that illustrated in FIG. 4 and similarly comprises a generally cylindrical body having an inlet 712, and outlet 714, and a passage extending therethrough. As shown the inlet 712 of the nozzle 710 is formed with an opening 713 that has a converging diameter provided at a first radius of curvature of θ3. A throat 716 is provided downstream of opening 713 (i.e. in the direction of flow 11). The throat includes a radius of curvature θ4 that is less than θ3. In other words, as shown in FIG. 7, the throat 716 is longer than the throat 416 shown in FIG. 4 and has a change in cross-sectional area that is less than that of the opening 713.

The throat 716 also includes a duct region shown at 726 that is similar to the duct region 26 shown in FIG. 4 and has the same functionality as described above. The nozzle 710 further includes a transition point 722 between the duct region 726 of the throat 716 and a diverging section 720, which forms the expansion region 724. The expansion region 724 ends in the outlet 714. As will be noted, the dimensions of the nozzle 710 are elongated compared to those of FIG. 4.

In one example, the nozzle of FIG. 7 may have an overall length of 5.512 inches with an inlet 712 of diameter 0.55 inches and an outlet 714 of diameter 0.453 inches. The length of the opening 713 may be 0.395 inches with a curvature θ3 that begins with the diameter of the inlet 712 (i.e. 0.55 inches) and ends with a diameter ahead of the throat 716 of 0.195 inches. The length of the narrowing entry of the throat 716 may be 0.393 inches and may have a degree of curvature θ4 of 2.76 degrees, whereby the diameter of this region reduces from 0.195 inches to 0.157 inches at the duct region 726. The length of the duct region 726 may be 0.788 inches and has a constant diameter of 0.157 inches. The length of the expansion region 724 (extending from the transition point 722 to the outlet 714) may be 3.936 inches.

Figure 8C:
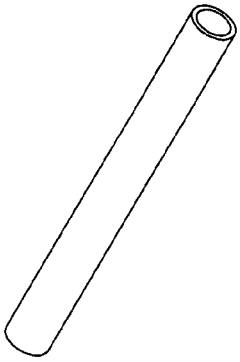
FIG. 8*c* is side perspective view of the nozzle of FIG. 8*b* showing the outlet thereof.
Figure 8A:
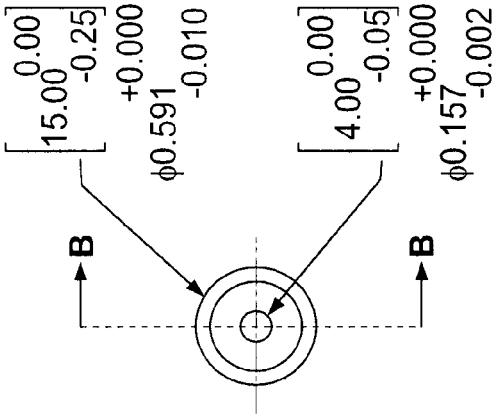
FIG. 8*a* is an end view of the inlet of one example of the nozzle of FIG. 7.
Figure 8B:
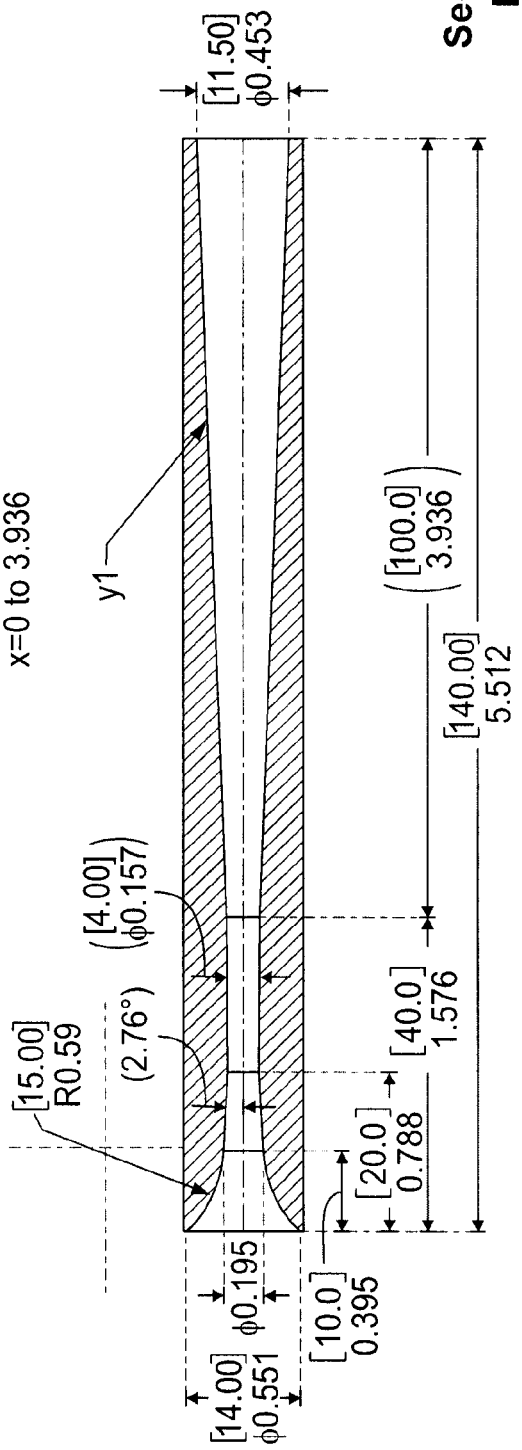
FIG. 8*b* is a side cross-sectional view of the nozzle of FIG. 8*a* taken along the line B-B thereof.
Figure 9C:
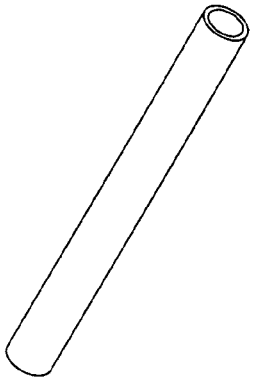
FIG. 9*c* is side perspective view of the nozzle of FIG. 9*b* showing the outlet thereof.
Figure 9A:
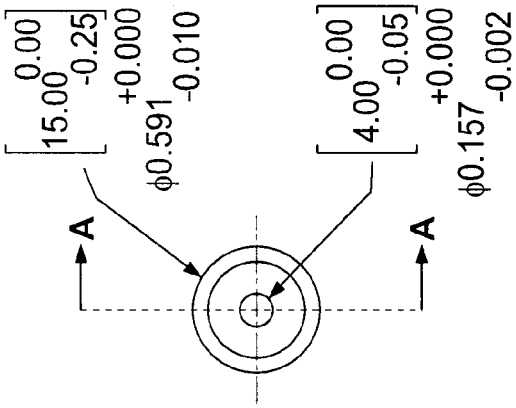
FIG. 9*a* is an end view of the inlet of another example of the nozzle of FIG. 7.
Figure 9B:
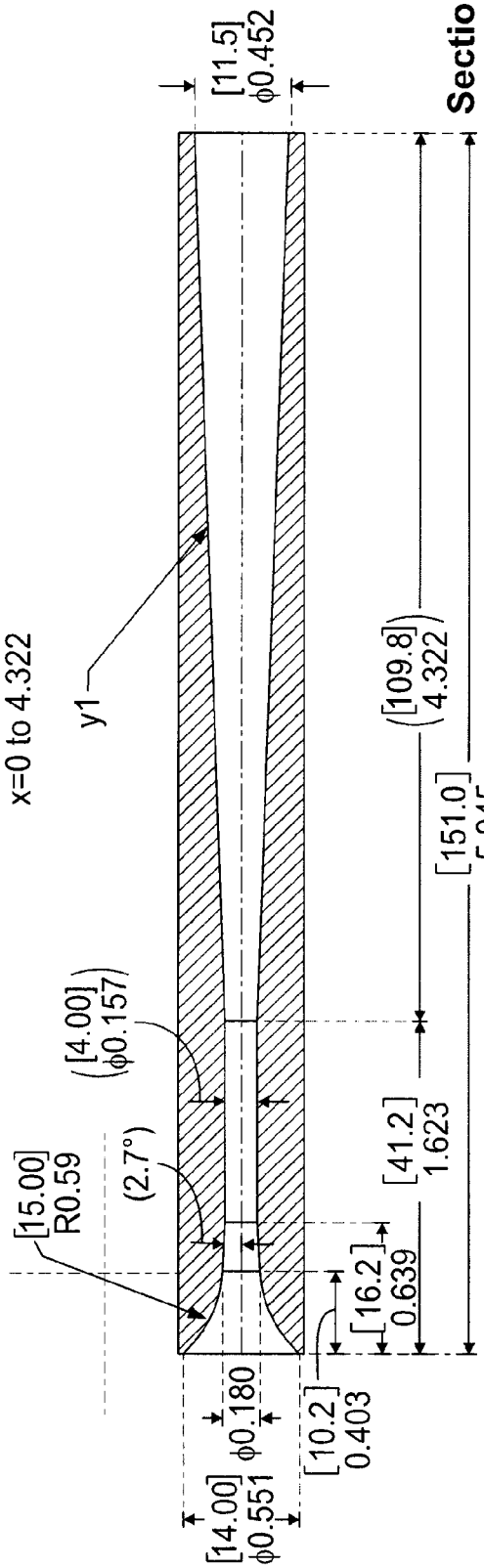
FIG. 9*b* is a side cross-sectional view of the nozzle of FIG. 9*a* taken along the line B-B thereof.

The above example of the nozzle of FIG. 7 is further illustrated in FIGS. 8*a*, 8*b* and 8*c*. Another example of the same nozzle, but with different dimensions, is illustrated in FIGS. 9*a*, 9*b*, and 9*c*. It will be understood that the aforementioned dimensions, and those shown in the aforementioned figure, relate to specific examples and are not intended to limit the scope of the present description. The dimensions will also be understood to vary based on acceptable manufacturing tolerances.

Figure 10:
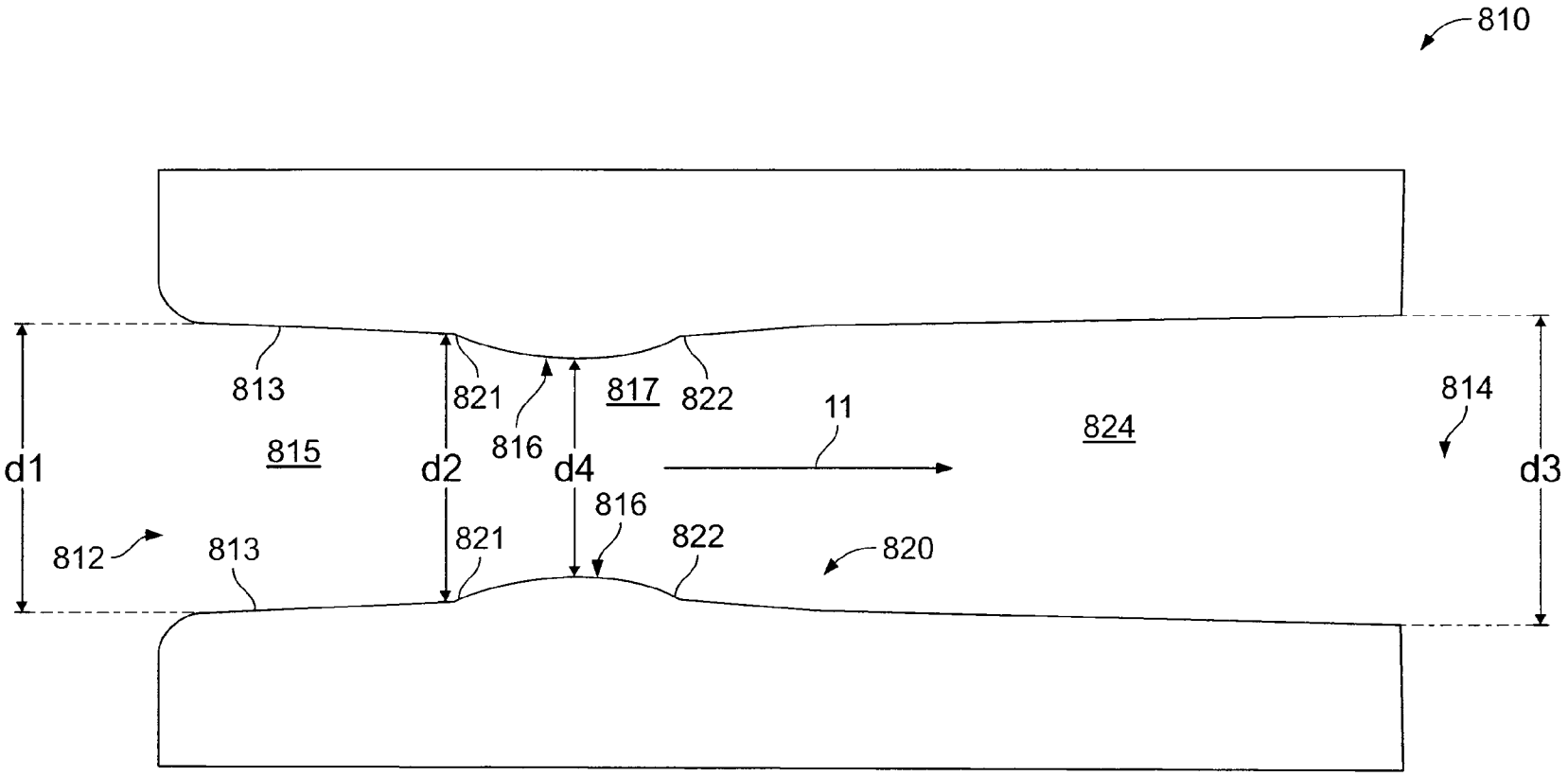
FIG. 10 is a side cross-sectional view of an inflow control nozzle according to another aspect of the present description.

FIG. 10 illustrates another aspect of a nozzle according to the present description, which is similar to the nozzle shown in FIG. 5. As shown in FIG. 10, the nozzle 810 comprises, as before, a generally cylindrical body having an inlet 812 and an outlet 814 and a passage extending there-through, wherein, generally, the passage includes two constriction regions prior to an expansion region. Fluid flows through the nozzle 810 in the direction shown by arrow 11. As with the previously described nozzles, the inlet 812 receives fluid from a reservoir (not shown). After passing through the nozzle 810, the fluid exits through the outlet 814. The passage extending between the inlet 812 and outlet 814 comprises first and second converging regions, 815 and 817, respectively, proximal to the inlet 812, and a diverging region 824 proximal to the outlet 814. The second convergent region 817 is formed by a throat 816. As will be understood, the second convergent region 817 is similar to the "duct region" as defined above with respect to the aspect illustrated in FIG. 5.

As shown in FIG. 10, the first converging region 815 is formed by a wall 813 having a gradually narrowing, or decreasing, diameter ranging from d1 at the inlet 812 to a reduced diameter d2 at a point 821 where the throat 816 begins.

The throat 816 forms the second converging region 817 and comprises a narrowed region, or constriction in the passage of the nozzle 810. More particularly, as shown in FIG. 10, the throat 816, located downstream (i.e. in the direction of arrow 11) of the inlet and downstream of the first converging region 815, is provided with throat diameter d4, which is smaller in dimension than d2. As noted above, the second converging region 817 begins at a transition point 821 and, as shown in FIG. 10, reduces in diameter from d2 to d4 in a relatively pronounced manner as compared to the gradual diameter reduction of the first converging region 815. The narrowest diameter of the second converging region 817, and of the passage of the nozzle 810, has the diameter d4 mentioned above. Further downstream (in the direction of arrow 11), the diameter of the second converging region 817 increases and may return generally to the diameter d2 at a point or corner 822 in the passage. It will be understood that the diameter d2 at the corner 822 may also be greater or less than d2 in some aspects of the description. This is illustrated, for example, in FIG. 11 (discussed further below), where the angles of the corners 821 and 822, taken with respect to the longitudinal axis of the nozzle 810, and identified as $\theta_1$ and $\theta_2$, respectively, are different.

The outlet 814 is provided with an outlet diameter d3 that is larger than d2 or d4 and, in one aspect, larger than d1.

The portion of the passage extending from the end of the second converging region 817, that is the corner 822, to the outlet 814 (i.e. in the direction 11) forms the diverging region 824 of the nozzle 810 passage and is provided with an increasing diameter ranging from d2 up to at least the diameter d3 of the outlet 814. In one aspect, as illustrated in FIG. 10, the diverging region 824 is formed by a wall 820 that gradually increases in diameter in a direction from the corner 822 to the outlet 814 (i.e. in the direction of arrow 11). As discussed above, the diverging region 824 may also be referred to as the pressure recovery region.

In FIG. 10, the diverging region 824 of the nozzle 810 is shown as having a gradually increasing diameter from the throat 816 to the outlet 814. However, in other aspects, the diameter d3 may be reached upstream of the outlet 814, in which case a portion of the end of the passage (i.e. the portion proximate to the outlet 814) may have a constant diameter d3 extending up to the outlet 814.

As shown in FIG. 10, the nozzle 810 includes a narrowed throat 816 between the converging region 815 and the diverging region 824. The additional narrow region 817 formed by the throat 816 has been found by the inventors to result in desired fluid flow characteristics. With the structure of the subject nozzle 810, a hot fluid (such as steam or a hot gas) flowing through the passage of the nozzle 810 is subjected to a pressure drop in the throat 816 and is flashed (i.e. the pressure within the throat is reduced below the vapour pressure of the fluid). The flowing fluid is then subjected to mixing when it enters the expansion region 24. In the absence of steam or where the concentration of steam is below a certain value, the vapour pressure of the fluid would be below the pressure exerted by flow through the throat 16 and, therefore, the flow rate of the fluid would be maintained. Therefore, the nozzle 810 provides an improvement in steam choking as compared to known Venturi nozzles.

More specifically, and without being bound to any particular theory, fluid flowing from a reservoir into production tubing may comprise one or more of: a "cold fluid", comprising a single phase of steam/water and hydrocarbons; a "hot fluid", comprising more than one phase, in particular a steam phase and a liquid hydrocarbon phase; and, steam, or, more particularly wet steam, which may also contain a hydrocarbon component but would still constitute a single phase. The nozzle described herein is primarily designed to convert a hot fluid into a single phase.

When wet steam or a hot fluid and steam mixture is flowed through the presently described nozzle, the converging regions 815 and 817 will cause acceleration of the fluid flow, and thus an increase in the fluid velocity. This increase in velocity is associated with a corresponding decrease in the pressure of the fluid. The generated pressure drop will generally result in steam to separate from the fluid mixture, thereby resulting in a more discrete steam phase. Ideally, before the fluid reaches the expansion region 824, the steam will be completely separated and will reach a state of equilibrium with the water content. Once removed from the rest of the fluid, and into a separate phase, it will be understood that the steam would have an increased velocity as it travels through the nozzle. This increased velocity is believed to serve as a carrier for the liquid phase of the fluid. As will be understood, the increase in velocity that is achieved by the nozzle described herein serves to further increase the pressure drop of the fluid, wherein, according to Bernoulli's principle, such pressure drop is proportional to the square of the flow velocity. In other words, an increase in the fluid velocity results in an exponential increase in the pressure drop. Thus, in one aspect, the nozzle described herein achieves a greater pressure drop by increasing the fluid velocity in a unique manner.

The expansion region 824 of the nozzle, following the throat 816, functions as a pressure recovery chamber, where the total pressure of the flowing fluid is increased, or "recovered". In the expansion region 824, the steam/water (in equilibrium) and hydrocarbon phases of the fluid are combined into a single phase. Preferably, in the expansion region 824, the fluid pressure is increased to the prescribed outlet pressure so as to avoid the formation of shockwaves within the nozzle.

With the nozzle described herein, the converging regions 815 and 817 have smooth, curved shapes, which helps the inflow of both single-phase liquid and the unwanted wet steam. The first converging region 815 of the nozzle 810, preferably having a smooth wall, promotes the flow of the single-phase liquid there-through due to the higher viscosity of such fluid. The throat 816, downstream of the first converging section 815 functions to further encourage the steam component to separate from the fluid and reach an equilibrium state. As mentioned above, the throat 816 may also comprise a smooth walled surface. Thus, the throat 816 serves to further accelerate the fluid passing there-through and further augment the pressure drop mentioned above. Downstream of the throat 816, flow velocity is proportional to the volumetric flow rate. Therefore, when steam is completely separated from the fluid, the volumetric flow rate will be increased, and the pressure drop (i.e. the pressure difference) will be increased accordingly.

Figure 11:
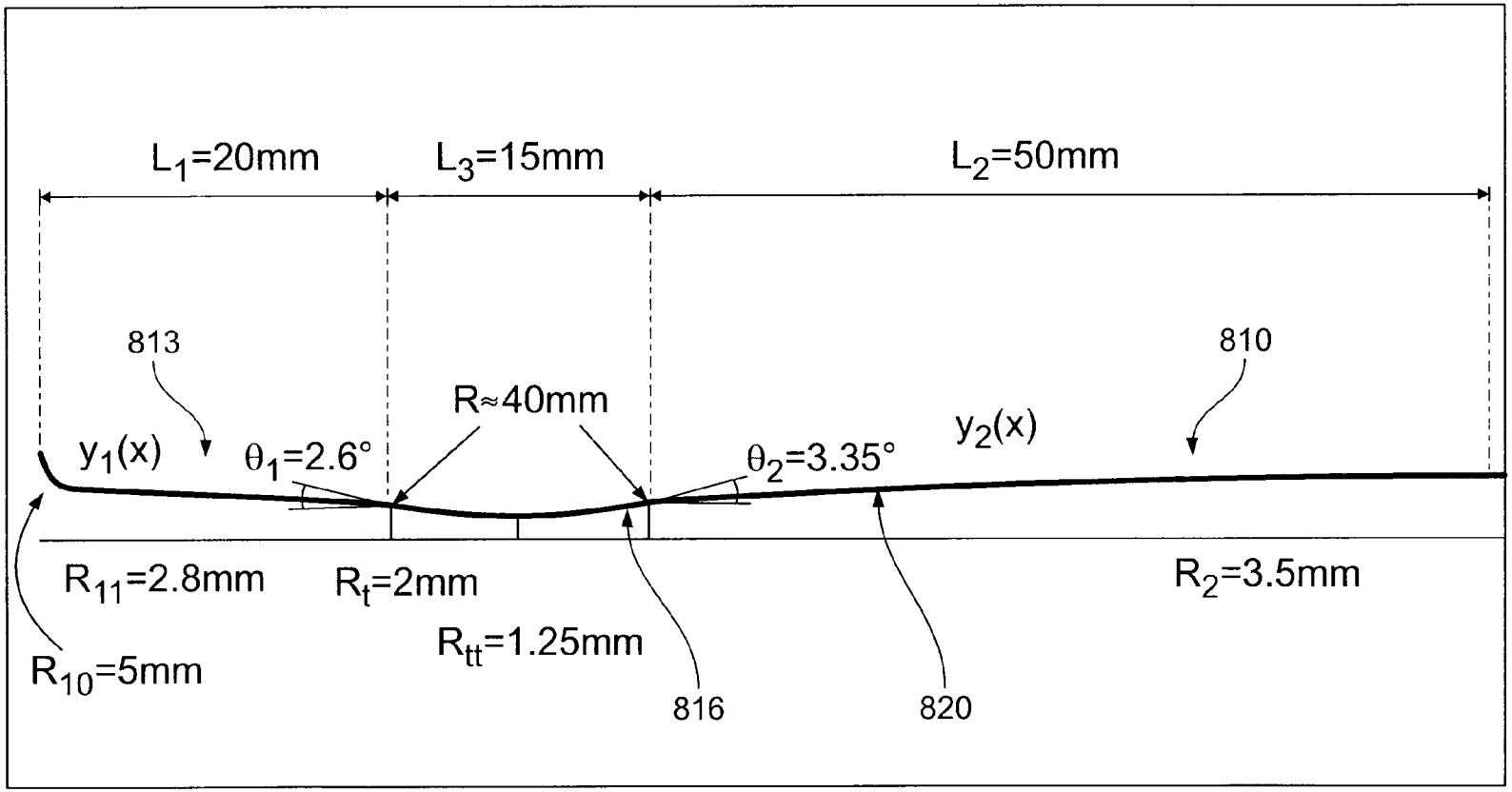
FIG. 11 is a schematic drawing showing a portion of the nozzle shown in FIG. 10 and exemplary dimensions thereof.

FIG. 11 illustrates a detail of one portion of the nozzle shown in FIG. 10, wherein exemplary dimensions are shown of the various sections of the nozzle 810. A portion of the wall of the passage of the nozzle 810 is illustrated in FIG. 11 in outline, wherein the wall 813 of first converging region 815, the throat 816 of the second converting region 817, and the wall 820 of the diverging region 824 are identified. As will be understood, all dimensions, including lengths, radii, and angles, shown in FIG. 11 are intended to be illustrative of one example of the nozzle 810 described herein. The dimensions or other details shown in FIG. 11 are not intended to limit the scope of the present description in any way.

The nozzle 810 may be utilized in the same manner as discussed above, such as in reference to FIG. 3. As also discussed above, the nozzle 810, as with the other nozzles described herein, may be combined with a suitable diverting means to allow fluids exiting the nozzle to be directed into the port of the tubing on which the nozzle is provided.

Figure 12:
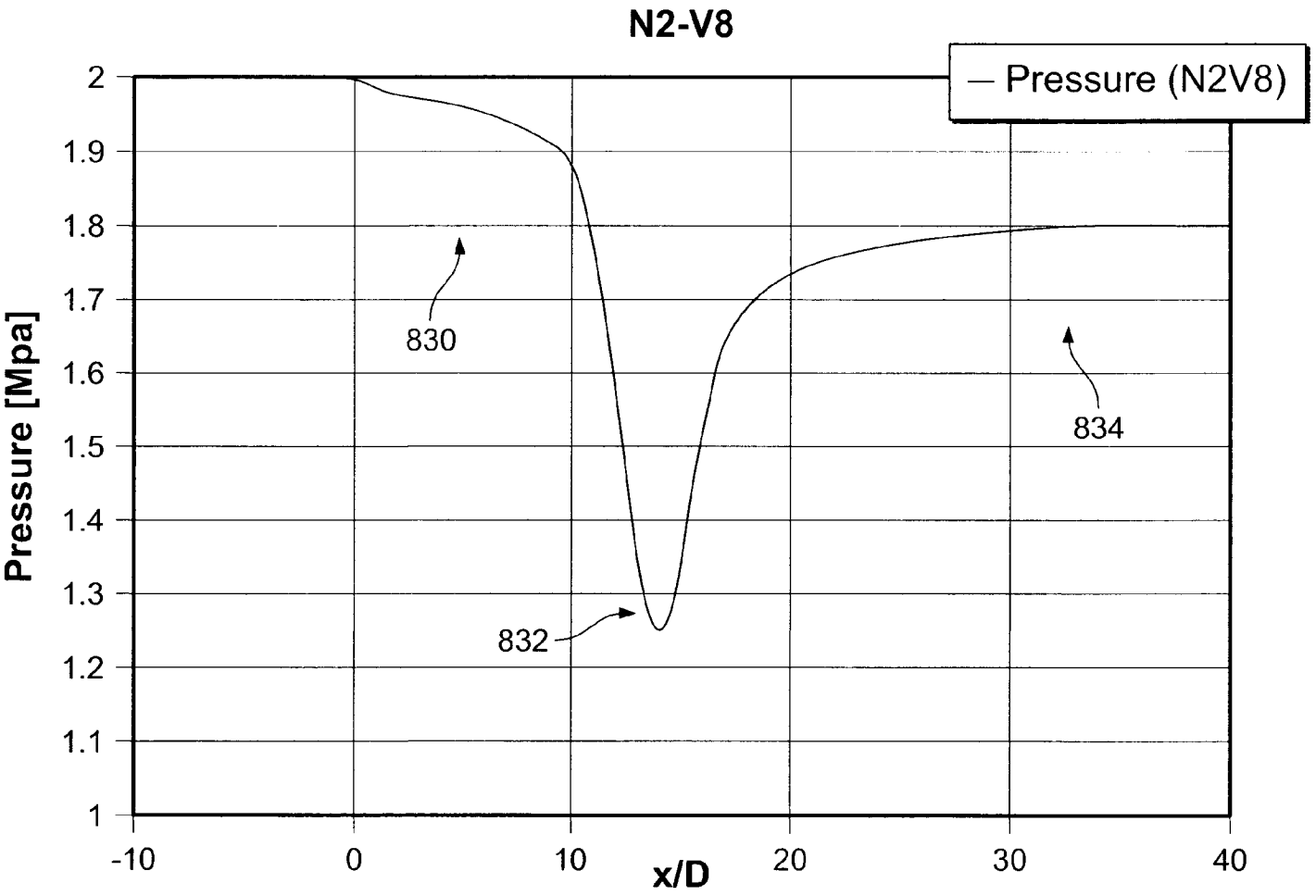
FIG. 12 illustrates the pressure variation of fluid flowing through the nozzle of FIG. 11.

FIG. 12 illustrates the pressure change of a fluid flowing through the nozzle 810 described herein and in particular illustrated in FIG. 11. In FIG. 12, the x-axis corresponds to the position along the length of the nozzle 810 and the y-axis corresponding to the pressure at each position. The curve in FIG. 12 shows how the pressure drop is generated across the nozzle 810, commencing at the first converging region 815 (as illustrated at 830 in FIG. 12) and in particular at the throat 816 (as illustrated at 832), and how the pressure is recovered in the diverging region 824 (as illustrated at 834).

Figure 13:
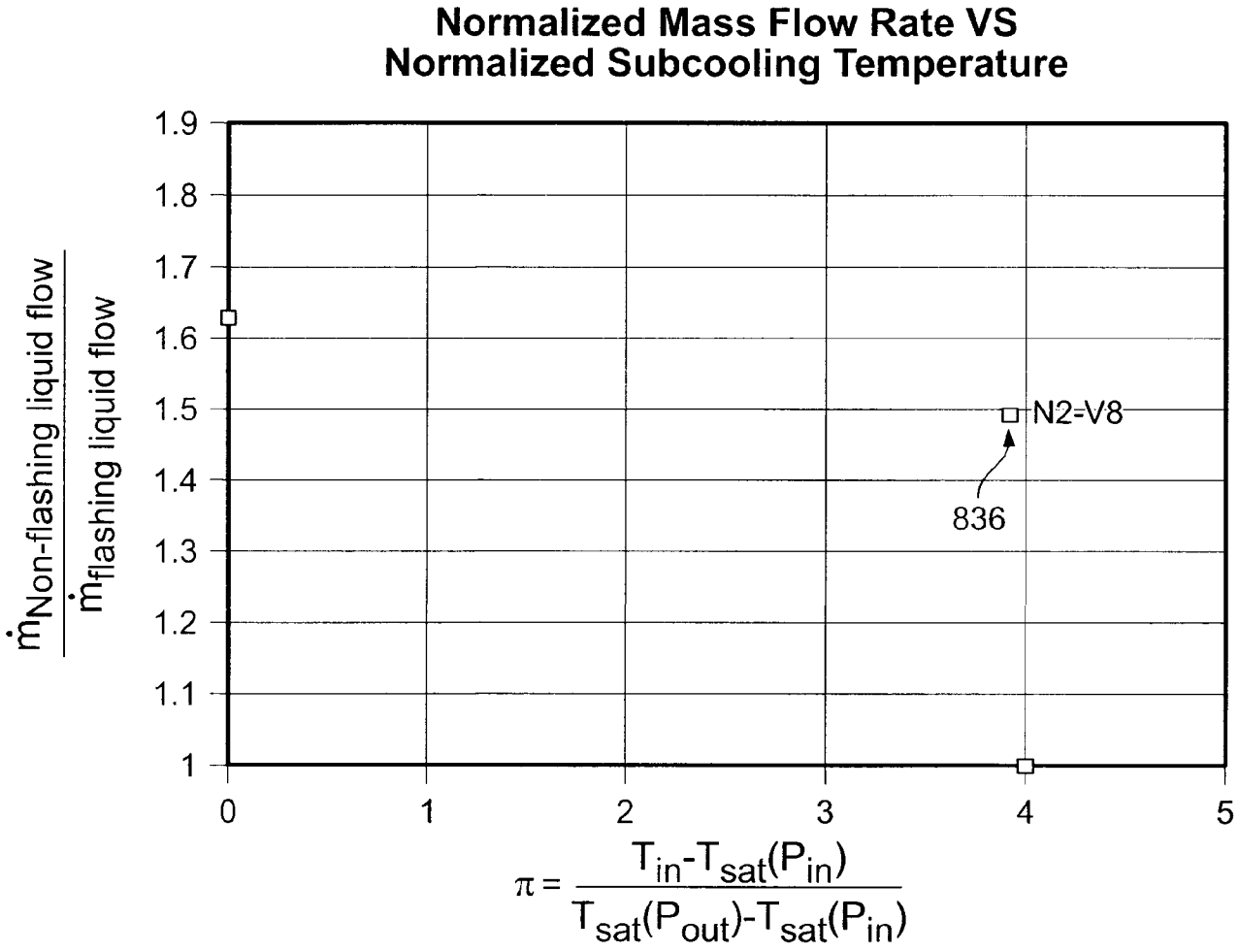
FIG. 13 is a normalized flow rate curve of fluid flowing through the nozzle of FIG. 11.

FIG. 13 illustrates a normalized flow rate curve for fluid flowing through the nozzle 810 illustrated in FIG. 11. The x-axis of FIG. 13 is the sub-cool index, which is the normalized sub-cooling temperature, and the y-axis is the normalized flow rate, which is the flow rate of fluid through nozzle 810 under cold water versus the flow rate under flashing conditions. As will be understood, with a higher the sub-cool index, the nozzle would be more restrictive under water flashing conditions, thereby resulting in better nozzle performance. As illustrated in FIG. 13, the nozzle 810 described herein achieved about 63% steam choking (as illustrated at 836), compared to 0% of a normal port (i.e. where no nozzle is used).

As will be understood, although the present description is mainly directed to the choking of steam inflow, the presently described nozzles may also be used to choke the flow of other "undesired" fluids such as water and gas or other fluids that injected into the formation such as viscosity modifiers, solvents etc.

In the present description, the fluid passage of the nozzles has been described as having a smooth wall. However, in certain cases, the wall may be provided with a rough or stepped finish.

Although the above description includes reference to certain specific embodiments, various modifications thereof will be apparent to those skilled in the art. Any examples provided herein are included solely for the purpose of illustration and are not intended to be limiting in any way. In particular, any specific dimensions or quantities referred to in the present description is intended only to illustrate one or more specific aspects are not intended to limit the description in any way. Any drawings provided herein are solely for the purpose of illustrating various aspects of the description and are not intended to be drawn to scale or to be limiting in any way. The scope of the claims appended hereto should not be limited by the preferred embodiments set forth in the above description but should be given the broadest interpretation consistent with the present specification as a whole. The disclosures of all prior art recited herein are incorporated herein by reference in their entirety.

The invention claimed is:

1. A system for controlling flow of fluids from a hydrocarbon-containing subterranean reservoir into production tubing, the system comprising:

a pipe segment adapted to form a section of the production tubing, the pipe segment having a first end and a second end and at least one port extending through the wall thereof for conducting reservoir fluids into the pipe segment;

at least one nozzle provided on the pipe segment, the nozzle having an inlet for receiving reservoir fluids, an outlet arranged in fluid communication with the at least one port, and a fluid conveying passage, extending between the inlet and the outlet, for channeling reservoir fluids in a first direction from the inlet to the outlet;

the fluid conveying passage having:

a first converging region, proximal to the inlet, the first converging region having a reducing cross-sectional area in the first direction;

a diverging region, proximal to the outlet, the diverging region having a first end having a first diameter and a second end positioned at the outlet and having a second diameter, wherein the first diameter is smaller than the second diameter and wherein the diverging region has an increasing cross-sectional area over at least a portion thereof in the first direction; and, a corner defining the first end of the diverging region.

2. The system of claim 1, wherein the at least one nozzle comprises a generally cylindrical body.

3. The system of claim 1, wherein the corner is mathematically not differentiable.

4. The system of claim 1, wherein the fluid conveying passage further comprises:

a second converging region between the first converging region and the diverging region, the second converging region defining a throat having a constricting portion proximal to the first converging region and an expanding portion proximal to the diverging region.

5. The system of claim 4, wherein the fluid conveying passage of the nozzle further comprises a region having a generally constant cross-sectional area that fluidly connects the converging region and the diverging region.

6. The system of claim 4, wherein a rate of decrease in the cross-sectional area of the second converging region is greater than a rate of decrease in the cross-sectional area of the first converging region.

7. The system of claim 4 , wherein the second converging region includes a constant cross-sectional portion between the constricting and expanding portions.

8. The system of claim 1, wherein the length of the diverging region is greater than the length of the first converging region or the second converging region.

9. The system of claim 1, wherein the length of the first converging region is greater than the length of the second converging region.

10. The system of claim 1, wherein the diameter of the nozzle outlet is greater than or equal to the diameter of the nozzle inlet.

11. The system of claim 1, wherein the diverging region has an increasing cross-sectional area up to the nozzle outlet.

12. The system of claim 1, wherein the diverging region has a constant cross-sectional area at a section proximal to the nozzle outlet.

13. The system of claim 1, wherein the fluid conveying passage of the nozzle has a generally smooth surface along its length.

14. The system of claim 1 further comprising a fluid flow diverter provided between the nozzle outlet and the port.

15. The system of claim 1 further comprising a screen for filtering reservoir fluids and wherein the screen is provided adjacent the nozzle inlet.

16. The system of claim 15 further comprising a retaining device for retaining the screen on the pipe, and wherein the retaining device includes a recess for receiving at least a portion of the nozzle.

17. The system of claim 1, wherein the fluid conveying passage of the nozzle further comprises a region having a generally constant cross-sectional area that fluidly connects the converging region and the diverging region.

18. A nozzle for controlling flow of fluids from a subterranean reservoir into a port provided on a pipe, the nozzle being adapted to be located on the exterior of the pipe adjacent the port, the nozzle having an inlet for receiving reservoir fluids, an outlet arranged in fluid communication with the port, and a fluid conveying passage, extending between the inlet and the outlet, for channeling reservoir fluids in a first direction from the inlet to the outlet;

the fluid conveying passage having:

a first converging region, proximal to the inlet, the first converging region having a reducing cross-sectional area in the first direction;

a diverging region, proximal to the outlet, the diverging region having a first end having a first diameter and a second end positioned at the outlet and having a second diameter, wherein the first diameter is smaller than the second diameter and wherein the diverging region has an increasing cross-sectional area over at least a portion thereof in the first direction; and, a corner defining the first end of the diverging region.

19. The nozzle of claim 18, wherein the at least one nozzle comprises a generally cylindrical body.

20. The nozzle of claim 18, wherein the corner is mathematically not differentiable.

21. The nozzle of claim 18, wherein the fluid conveying passage further comprises:

a second converging region between the first converging region and the diverging region, the second converging region defining a throat having a constricting portion proximal to the first converging region and an expanding portion proximal to the diverging region.

22. The nozzle of claim 21, wherein a rate of decrease in the cross-sectional area of the second converging region is greater than a rate of decrease in the cross-sectional area of the first converging region.

23. The nozzle of claim 21, wherein the second converging region includes a constant cross-sectional portion between the constricting and expanding portions.

24. The nozzle of claim 21, wherein the fluid conveying passage further comprises a region having a generally constant cross-sectional area that fluidly connects the converging region and the diverging region.

25. The nozzle of claim 18, wherein the length of the diverging region is greater than the length of the first converging region or the second converging region.

26. The nozzle of claim 18, wherein the length of the first converging region is greater than the length of the second converging region.

27. The nozzle of claim 18, wherein the diameter of the nozzle outlet is greater than or equal to the diameter of the nozzle inlet.

28. The nozzle of claim 18, wherein the diverging region has an increasing cross-sectional area up to the nozzle outlet.

29. The nozzle of claim 18, wherein the diverging region has a constant cross-sectional area at a section proximal to the nozzle outlet.

30. The nozzle of claim 18, wherein the fluid conveying passage of the nozzle has a generally smooth surface along its length.

31. The nozzle of claim 18 further comprising a fluid flow diverter provided between the nozzle outlet and the port.

32. The nozzle of claim 18 further comprising a screen for filtering reservoir fluids and wherein the screen is provided adjacent the nozzle inlet.

33. The nozzle of claim 23 further comprising a retaining device for retaining the screen on the pipe, and wherein the retaining device includes a recess for receiving at least a portion of the nozzle.

34. The nozzle of claim 18, wherein the fluid conveying passage further comprises a region having a generally constant cross-sectional area that fluidly connects the converging region and the diverging region.

* * * * *